US005327499A

United States Patent [19]

Sohayda

[11] Patent Number: 5,327,499

[45] Date of Patent: Jul. 5, 1994

[54] SAFETY DEVICE FOR A HEARING AID

[76] Inventor: Mary D. Sohayda, 98 Washington Ave., Carteret, N.J. 07008

[21] Appl. No.: 896,385

[22] Filed: Jun. 10, 1992

[51] Int. Cl.[5] ..... H04R 25/00

[52] U.S. Cl. ..... 381/68; 381/68.6; 63/12

[58] Field of Search ..... 381/68.6, 68, 68.2, 381/68.3, 68.4, 69, 69.2, 68.5, 151; 181/129, 130, 135; 455/351; 63/12, 13, 1.1, 2

[56] References Cited

U.S. PATENT DOCUMENTS

| | | | |
|---|---|---|---|
| 2,647,955 | 8/1953 | Stalcup | 381/69.2 |
| 2,909,619 | 10/1959 | Hollingsworth | 381/68 |
| 2,956,422 | 10/1960 | Davidson | 63/13 |
| 3,068,954 | 12/1962 | Strzalkowski | 381/68.3 |
| 3,394,226 | 7/1968 | Andrews, Jr. | 381/72 |
| 4,641,370 | 2/1987 | Oyamada | 455/351 |
| 4,901,355 | 2/1990 | Moore | 381/68.5 |

FOREIGN PATENT DOCUMENTS

| | | | |
|---|---|---|---|
| 3268615 | 11/1991 | Japan | 455/351 |
| 0673365 | 2/1990 | Switzerland | 381/68 |

OTHER PUBLICATIONS

Fresh Earrings, Andrew H. Arnott, "Life" Magazine, Apr. 7, 1941, p. 106.

*Primary Examiner*—Forester W. Isen
*Assistant Examiner*—Huyen D. Le
*Attorney, Agent, or Firm*—Ezra Sutton

[57] ABSTRACT

A device for preventing the loss of a hearing aid, which includes a chain, a device for attaching one end of the chain to the hearing aid, and a device for attaching the other end of the chain to an earring or other device worn by the wearer of the hearing aid.

5 Claims, 2 Drawing Sheets

SAFETY DEVICE FOR A HEARING AID

FIELD OF THE INVENTION

The present invention relates to a safety device for preventing the loss of a hearing aid while it is being worn.

BACKGROUND OF THE INVENTION

Modern hearing aids are worn on the outer ear and are placed on the external auditory canal. They remain in place solely by the "snug fit" achieved between the ear and the hearing aid. However, this "snug fit" is not always efficient for keeping the hearing aid in place, and the hearing aid will fall out of the ear on occasion. This may result in loss of the hearing aid, which is an expensive item to replace.

In the past, devices have been designed to conceal the use of a hearing aid with covers or earrings. For example, U.S. Pat. No. 2,909,619 has a safety device that prevents loss of the hearing aid. In that patent, the hearing aid is actually fastened to the pierced lobe of an ear. The type of hearing aid shown has long since been outdated by more modern devices.

It is the object of the present invention to provide a safety device which will prevent the loss of modern hearing aids by the wearer.

It is also an object of the present invention to provide a system that includes a chain and a modified hearing aid with a chain attaching-device. This can be attached to an earring and thereby prevent the loss of the hearing aid if it falls out of the ear.

SUMMARY OF THE INVENTION

In accordance with the principles of the present invention, there is provided a device for preventing the loss of a hearing aid. A chain is attached to the hearing aid and is also attached to an earring, thereby preventing loss of the hearing aid should it fall out of the ear during use.

BRIEF DESCRIPTION OF THE DRAWINGS

Further objects, features, and advantages of the present invention will become apparent upon consideration of the detailed description of the presently-preferred embodiment, when taken in conjunction with the accompanying drawings wherein.

DETAILED DESCRIPTION OF THE PREFERRED EMBODIMENT

Figure 1:
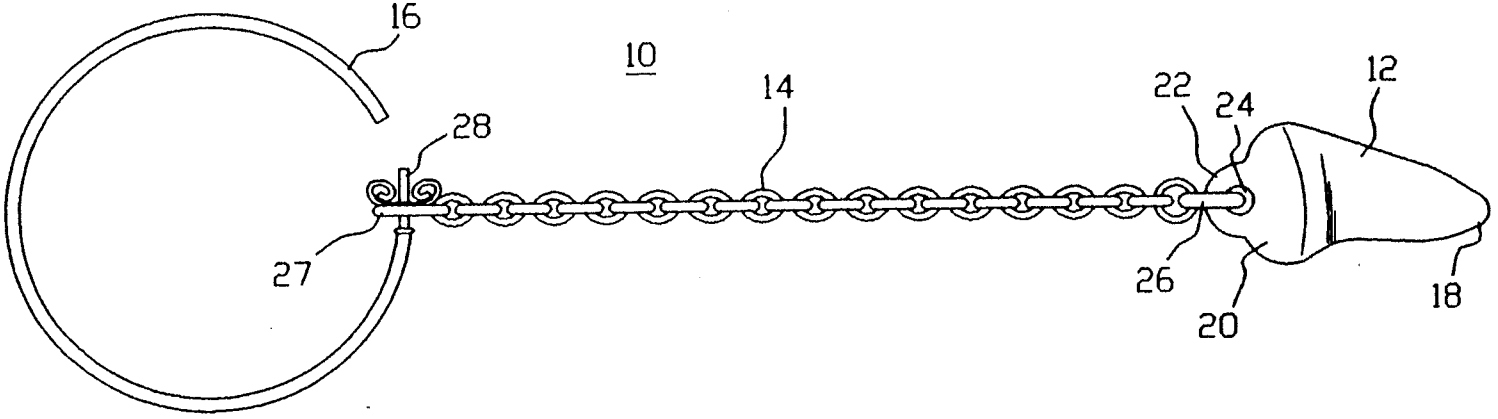
FIG. 1 is a view illustrating the hearing aid safety device and how the individual members attach to form the invention.

Referring to FIG. 1, there is shown a hearing aid safety device 10 embodying the principles of the present invention. The safety device 10 comprises a modified hearing aid 12 and a chain 14 for attachment to an earring 16.

Figure 2:
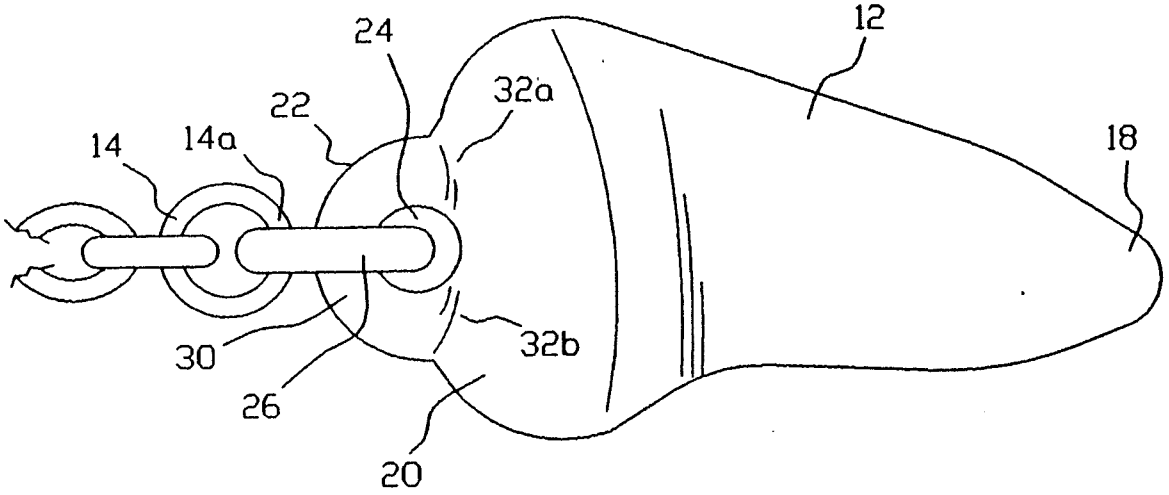
FIG. 2 is a side view of the modified hearing aid of the present invention.
Figure 3:
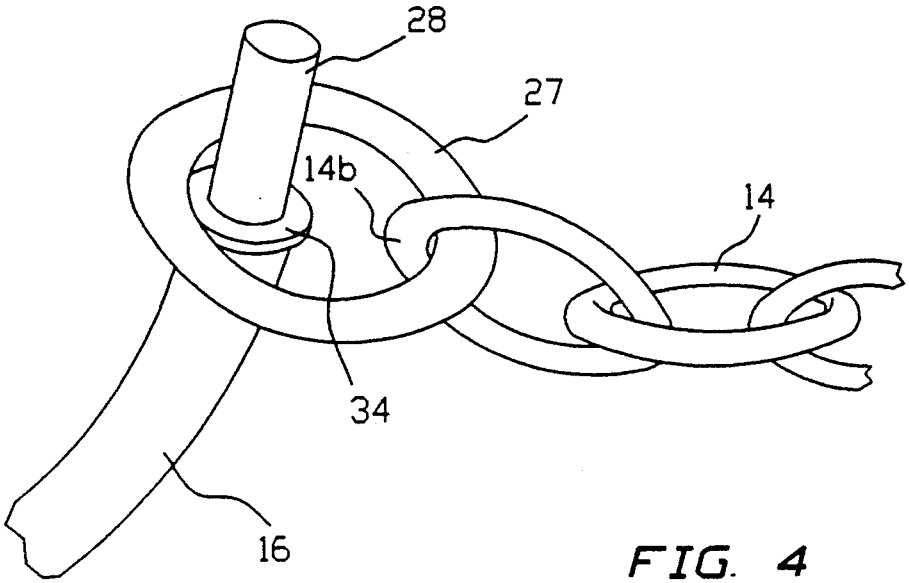
FIG. 3 shows the chain attachment to the post of an earring.
Figure 4:
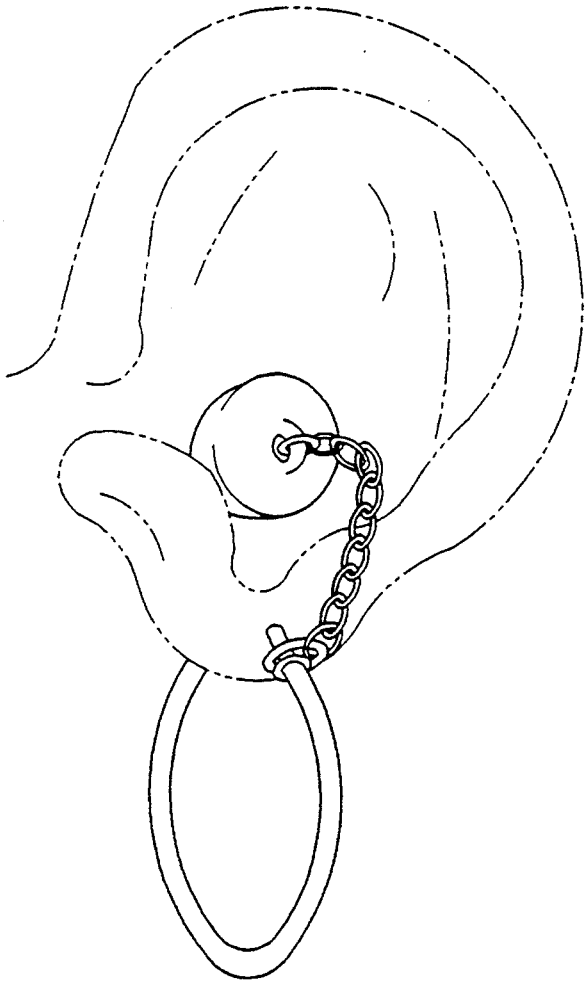
FIG. 4 is a view of the invention as it appears when attached to the ear.

Referring to FIGS. 1, 2, and 3, there is shown a hearing aid 12 having a first end 18 for facing into the ear of the wearer and a second end 20 for facing out of the ear of the wearer. There is a chain-attaching device 22 integrally formed on the second end 20 of the hearing aid 12 and a hole 24 formed in the chain-attaching device 22.

The chain-attaching device 22 includes a semicircular member 30 having two ends **32*a* and 32*b* which are integrally molded to the second end 20 of the hearing aid 12. The semicircular member 30 defines the hole 24 of the chain-attaching device 22**.

A chain 14 is attached to the hole 24 in the chain-attaching device 22 by a first ring 26 on the first end **14*a* of the chain 14**.

Referring to FIG. 3, there is shown the second end **14*b* of the chain 14 attached to a second ring 27. The post 28 of the earring 16 passes through the second ring 27, and the post locks in a clasp 34 when the earring 16** is placed on the ear.

If the hearing aid 12 falls out of the ear, it will be suspended from the earring by the chain 14. It should also be understood that ring 27 can be attached to the temple of an eyeglass frame, so that if the hearing aid 12 falls out of the ear, it will be suspended from the temple by the chain 14. This prevents loss of the hearing aid 12.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A safety device for a hearing aid, comprising:

a) a hearing aid having a first end for facing into the ear of the wearer, and a second end for facing out of the ear of the wearer;

b) chain-attaching means integrally formed on the second end of said hearing aid;

c) a hole formed in said chain-attaching means;

d) a chain attached to the hole in said chain-attaching means, e) a first ring on the first end of said chain for attachment to the chain-attaching means of the hearing aid; and f) a second ring on the second end of said chain for attachment to an earring worn by the wearer of the hearing aid.

2. A safety device in accordance with claim 1, wherein said chain-attaching means includes an extension integrally formed on the outer surface of said hearing aid.

3. A safety device in accordance with claim 1, wherein said chain-attaching means includes a member having two ends which are integrally molded to the body of said hearing aid, said member defining said hole between the body of said hearing aid and said member.

4. A safety device in accordance with claim 3, wherein said member is in the shape of a semicircle and said two ends are integrally molded to said hearing aid.

5. A safety device in accordance with claim 1, wherein said chain-attaching means is made of plastic.

* * * * *